US009688436B2

(12) United States Patent
Sakaguchi

(10) Patent No.: US 9,688,436 B2
(45) Date of Patent: Jun. 27, 2017

(54) GLASS ROVING PACKAGE

(71) Applicant: NIPPON ELECTRIC GLASS CO., LTD., Shiga (JP)

(72) Inventor: Takeshi Sakaguchi, Shiga (JP)

(73) Assignee: Nippon Electric Glass Co., Ltd., Shiga (JP)

( * ) Notice: Subject to any disclaimer, the term of this patent is extended or adjusted under 35 U.S.C. 154(b) by 247 days.

(21) Appl. No.: 14/377,181

(22) PCT Filed: Apr. 11, 2013

(86) PCT No.: PCT/JP2013/060978
§ 371 (c)(1),
(2) Date: Aug. 7, 2014

(87) PCT Pub. No.: WO2013/175889
PCT Pub. Date: Nov. 28, 2013

(65) Prior Publication Data

US 2015/0108036 A1 Apr. 23, 2015

(30) Foreign Application Priority Data

May 22, 2012 (JP) ..... 2012-116182

(51) Int. Cl.
*B65D 85/67* (2006.01)
*B65D 19/00* (2006.01)
(Continued)

(52) U.S. Cl.
CPC ..... *B65D 19/0063* (2013.01); *B65D 19/44* (2013.01); *B65D 71/0096* (2013.01);
(Continued)

(58) Field of Classification Search
CPC .... B65D 19/44; B65D 19/0063; B65D 71/04; B65D 71/0096; B65D 81/127; B65D 2571/00043
(Continued)

(56) References Cited

U.S. PATENT DOCUMENTS 3,109,540 A * 11/1963 Klimpl ..... B65D 71/0096 206/393
4,386,704 A * 6/1983 Maillet ..... B21F 33/002 100/2
(Continued)

FOREIGN PATENT DOCUMENTS

CN 101277878 A 10/2008
FR 2852582 9/2004
(Continued)

OTHER PUBLICATIONS

Official Action for Corresponding Chinese Patent Application No. 201380008169.5 along with machine translation of a main part thereof issued Jun. 3, 2015.
(Continued)

*Primary Examiner* — Luan K Bui
(74) *Attorney, Agent, or Firm* — Renner, Otto, Boisselle & Sklar, LLP

(57) ABSTRACT

A glass roving package 200 is provided which has a simple configuration which can prevent shifting and collapse of the glass roving package 200 during transportation of the package, and for which it is easier to package glass rovings 100 and unpack, and the cost of the glass roving package 200 can be reduced. The glass roving package 200 includes groups of glass rovings 100 stacked on top of each other on a base board 20, the glass rovings 100 in each group being arranged, and a wrapping material wrapped around an outer circumferential portion of the groups of glass rovings 100. A displacement prevention sheet 10 is interposed between a
(Continued)

lower group of glass rovings 100 and an upper group of glass rovings 100 in order to prevent the upper group of glass rovings 100 from being displaced during transportation of the package.

3 Claims, 6 Drawing Sheets

(51) Int. Cl.
*B65D 71/00* (2006.01)
*B65D 19/44* (2006.01)
*B65D 71/04* (2006.01)
*B65D 81/127* (2006.01)

(52) U.S. Cl.
CPC ..... *B65D 71/04* (2013.01); *B65D 81/127* (2013.01); *B65D 2571/00043* (2013.01)

(58) Field of Classification Search
USPC ..... 206/386, 389, 391, 393, 397, 398, 523, 206/593, 597, 497
See application file for complete search history.

(56) References Cited

U.S. PATENT DOCUMENTS 4,744,465 A * 5/1988 Parker ..... B65D 71/0096 206/497
4,801,024 A * 1/1989 Flum ..... B65D 71/70 108/53.1
4,998,619 A * 3/1991 Sowa ..... B65D 71/0096 108/53.5
5,005,706 A * 4/1991 LaTondress ..... B32B 27/02 206/391
5,259,524 A * 11/1993 Eckert ..... B65D 71/50 206/446
5,339,957 A * 8/1994 Carstens ..... B65D 21/0224 106/36
5,346,065 A 9/1994 Dunbar et al.
5,531,327 A * 7/1996 Darby ..... B65D 19/18 108/53.5
5,551,563 A * 9/1996 Allen ..... B65D 71/0096 206/394
5,758,771 A * 6/1998 Rose ..... B65D 19/44 206/386
6,729,490 B2 * 5/2004 Bylo ..... B65D 21/083 206/597
2006/0108249 A1 * 5/2006 Riddleburgh ..... B65D 81/053 206/453
2008/0017650 A1 * 1/2008 Evans ..... B65D 71/72 220/507
2009/0166235 A1 * 7/2009 Mansson ..... B65D 71/0096 206/391
2009/0288976 A1 * 11/2009 Shiraki ..... B65D 21/0224 206/386
2012/0285851 A1 * 11/2012 Carter ..... B65D 71/0088 206/386

FOREIGN PATENT DOCUMENTS

JP 62-134801 U 8/1987
JP 1996-002549 1/1996
JP 2005-212803 8/2005
JP 2007-45501 2/2007
JP 2010-235234 10/2010

OTHER PUBLICATIONS

Third Office Action issued for Chinese patent application No. 201380008169.5 along with machine translation of a main part thereof issued Apr. 19, 2016.
Second Official Action for Corresponding Chinese Patent Application No. 201380008169.5 together with machine translation of a main part thereof issued Oct. 29, 2015.
PCT/JP2013/060978; PCT International Search Report and Written Opinion of the International Searching Authority dated Jul. 5, 2013.
First Office Action issued for Japanese patent Application No. 2013-516409 issued Oct. 25, 2016 along with machine translation thereof.
Fourth Office Action issued for Chinese patent Application No. 201380008169.5 along with machine translation thereof.
Decision of Refusal issued for Japanese patent Application No. 2013-516409 issued Mar. 21, 2017 along with machine translation thereof.

* cited by examiner

[FIG. 1]
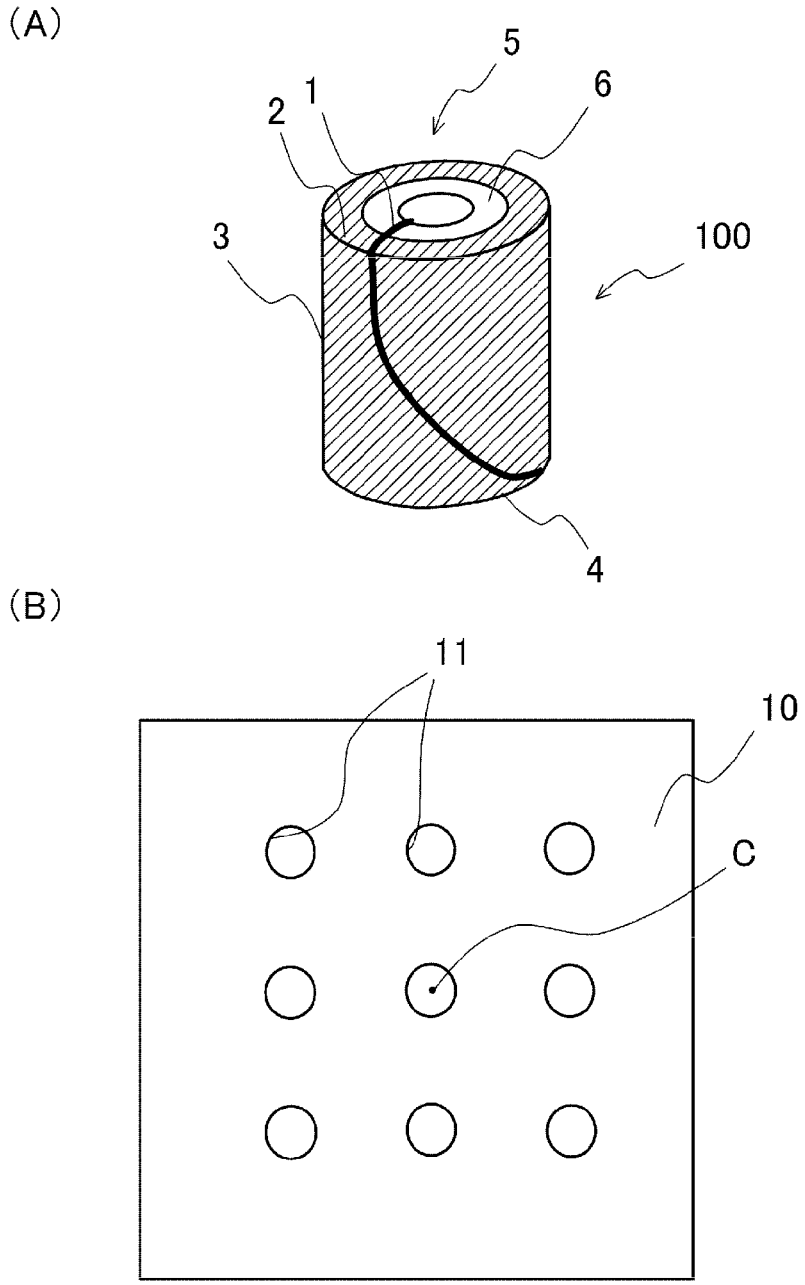

[FIG. 2]
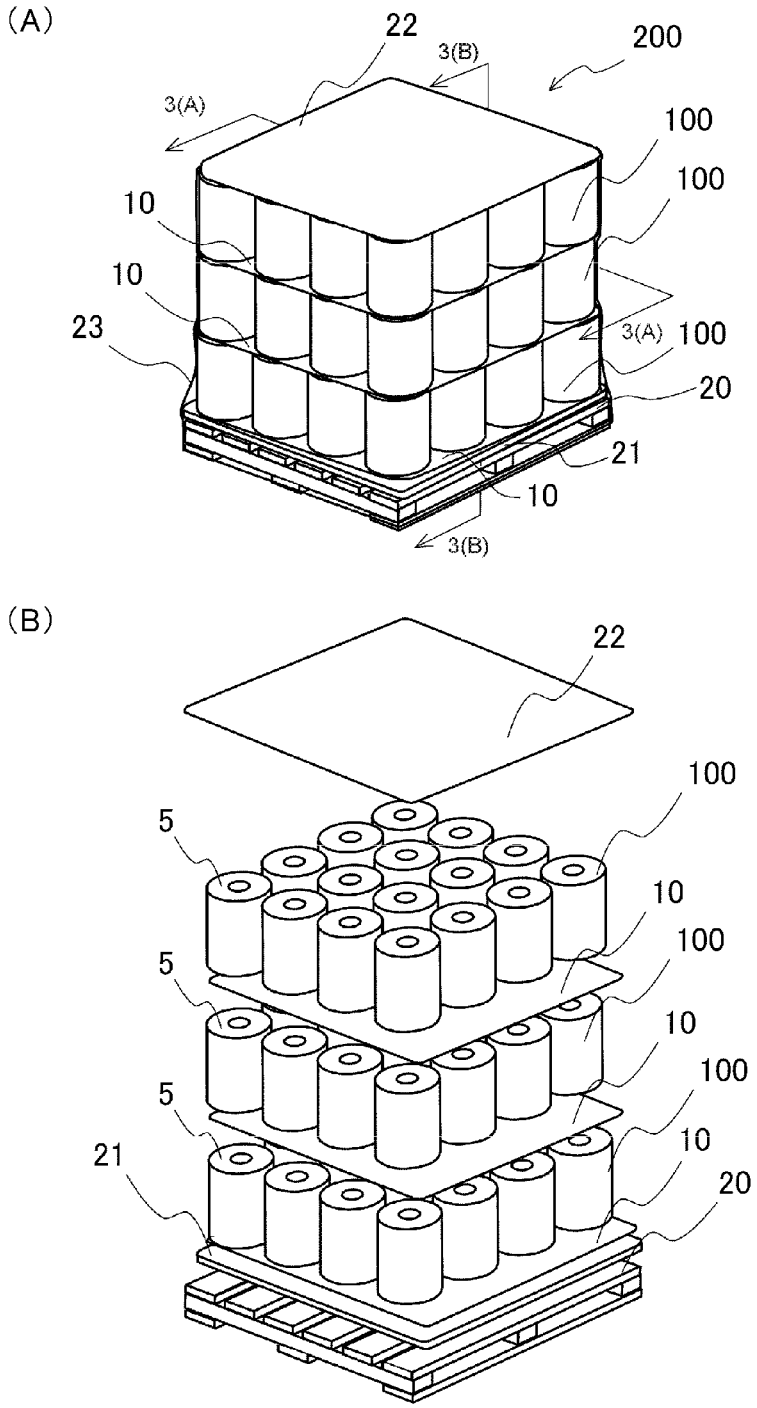

[FIG. 3]
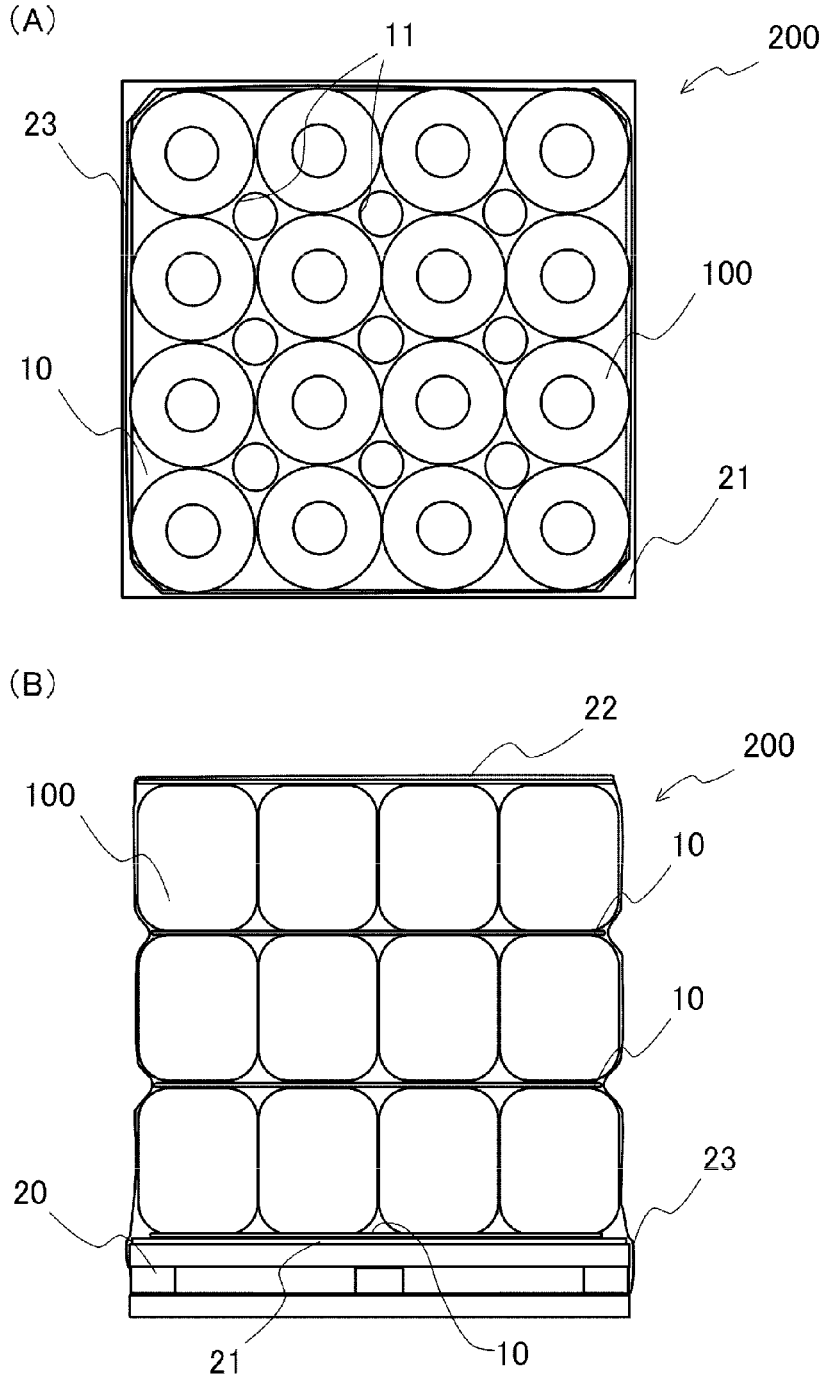

[FIG. 4]
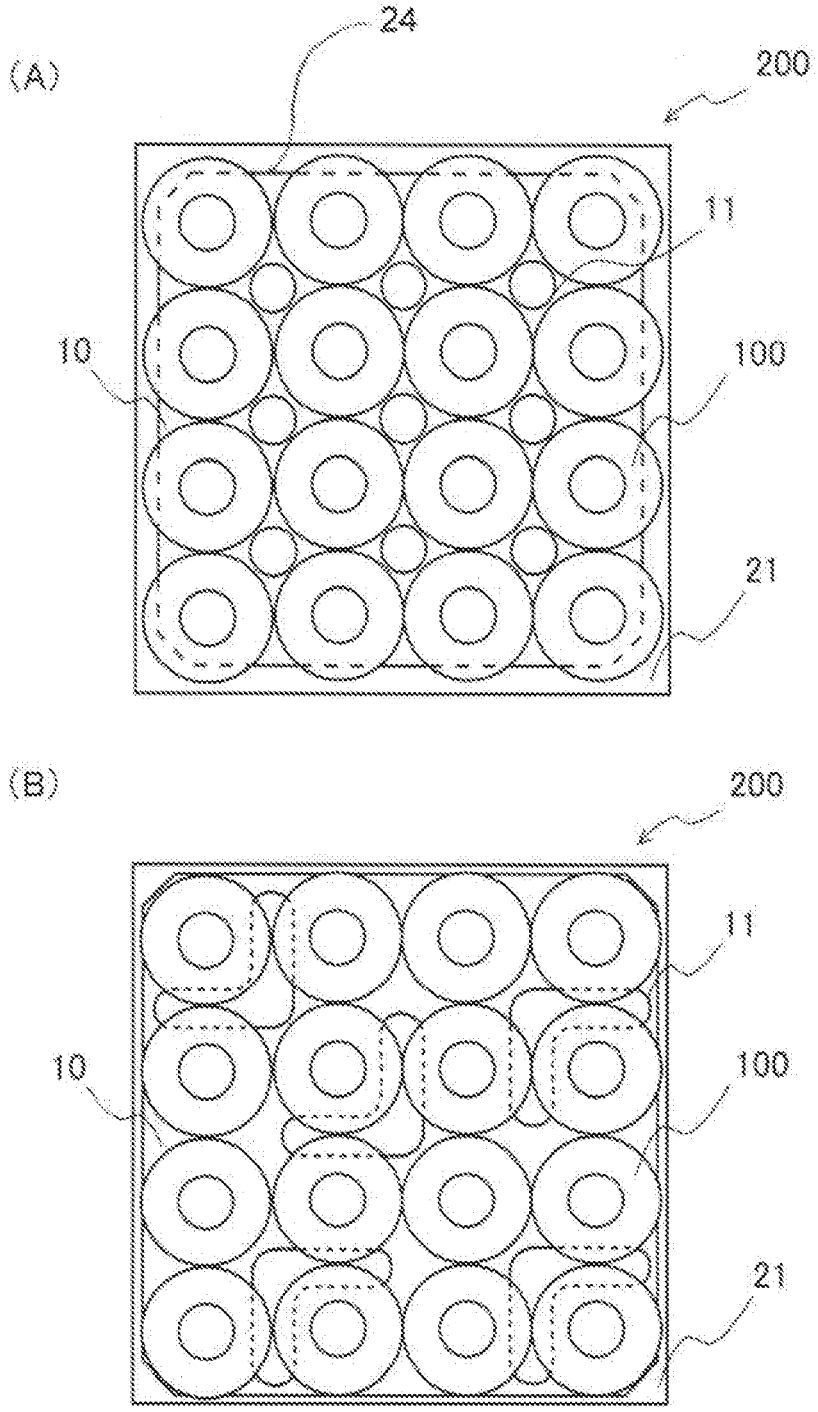

[FIG. 5]
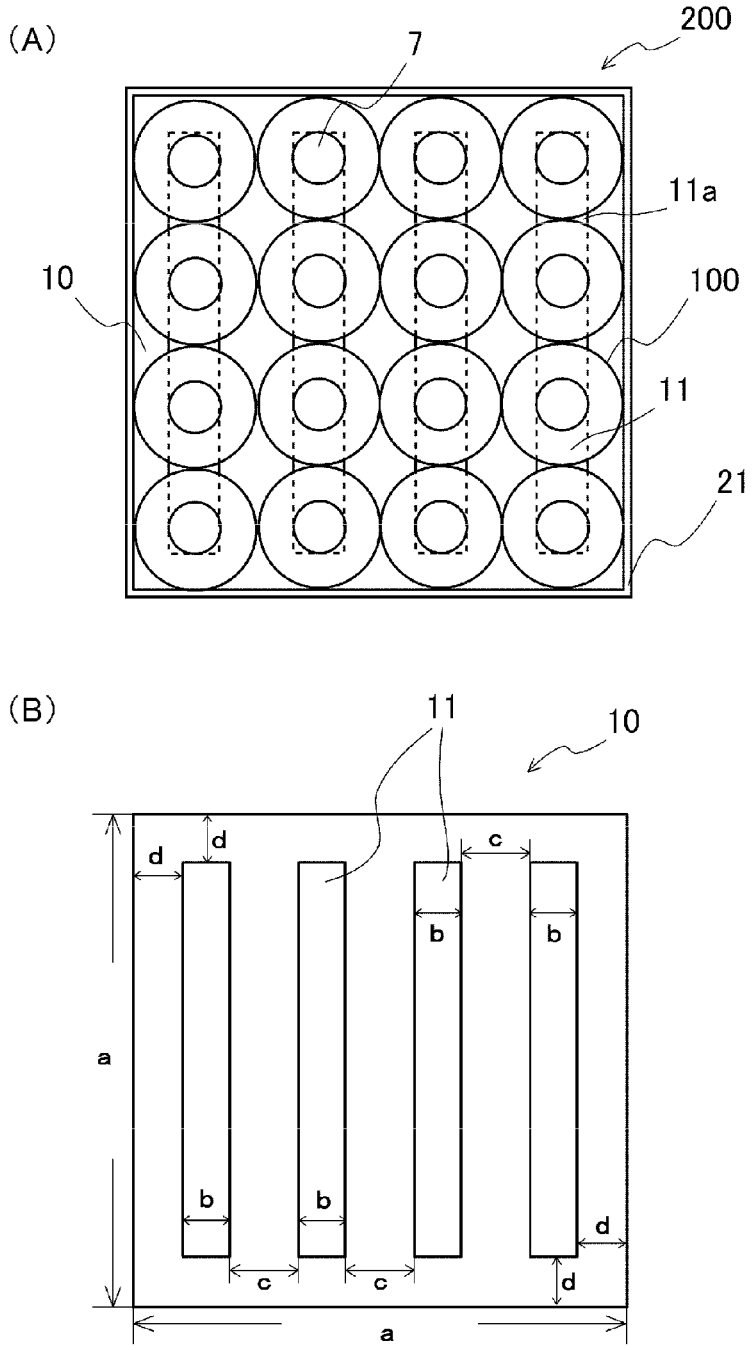

[FIG. 6]
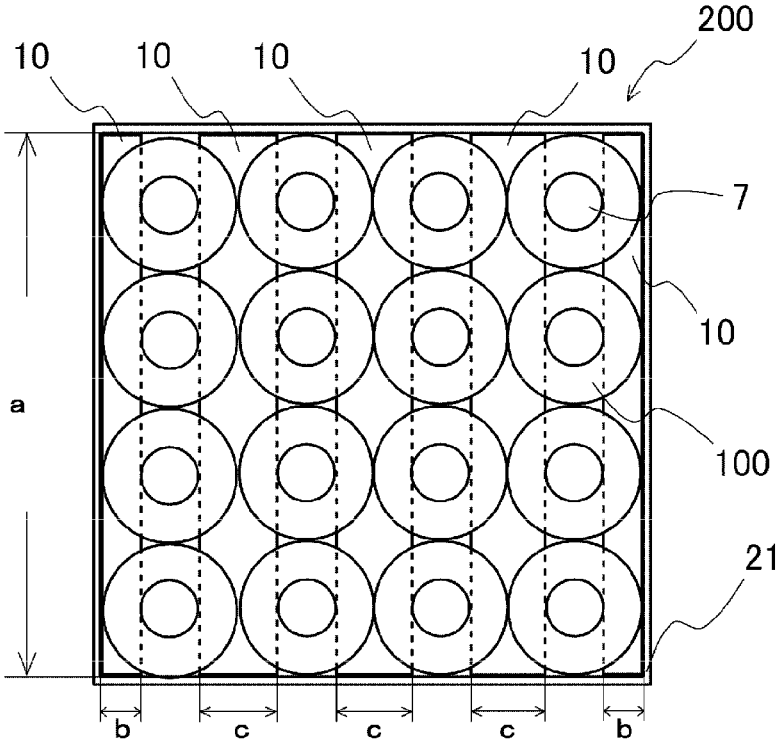

GLASS ROVING PACKAGE

The present application is a U.S. National Stage Application based on and claiming benefit of and priority under 35 U.S.C. §371 to International Application No. PCT/JP2013/060978 filed 11 Apr. 2013, which in turn claims benefit of and priority to Japanese Application No. 2012-116182, filed 22 May 2012, the entirety of each of which is hereby incorporated herein by reference.

TECHNICAL FIELD

The present invention relates to a glass roving package in which groups of glass rovings are stacked on top of each other on a base board, glass rovings in each group being arranged, and a wrapping material is wrapped around an outer circumferential portion of the groups of glass rovings.

BACKGROUND ART

Glass rovings are used as reinforcing materials for composite materials including a resin and the reinforcing material, or reinforcing materials for concrete, mortar, etc. The composite material is molded by a technique, such as sheet molding compound (SMC) etc., and is used in industrial products, such as glass-fiber reinforced plastic (FRP) etc.

Glass rovings are typically neatly arranged in a plurality of rows and a plurality of columns on a base board. Groups of glass rovings thus arranged are stacked on top of each other, and a film is wrapped (by shrink wrap etc.) around an outer circumferential portion of the groups of glass rovings, to form a glass roving package, which is shipped to a user. As a technique related to such a glass roving package, for example, Patent Literature 1 describes a technique of stacking groups of wrapped units with a plate-like object being interposed between each group of wrapped units, and shrink-wrapping the collection of stacked cakes using resin film, thereby improving the physical integrity (i.e., the package's ability to hold together).

A carton (e.g., a box made of cardboard or resin for covering) is used as an outer wrap of a glass roving package in order to prevent shifting, collapse, etc. of the glass roving package, although the use has not been disclosed as a conventional technique.

CITATION LIST

Patent Literature

Patent Literature 1: Japanese Unexamined Patent Application Publication No. 2007-45501

SUMMARY OF INVENTION

Technical Problem

In the above technique of Patent Literature 1, the plate-like object is made of cardboard, paperboard, synthetic resin plate, etc. Therefore, during transportation of the glass roving package, if external force is exerted on the glass roving package due to, for example, sudden start or stop of a transport car, transport train, etc. or connection of a trailer, train, etc., the wrapped units are likely to slide on the plate-like object, leading to shifting or collapse of the glass roving package.

To prevent such shifting or collapse of the glass roving package during transportation of the package, the above carton may be used as the outer wrap of the glass roving package. In this case, it takes a lot of time and effort to package glass rovings using the carton, and it also takes a lot of labor for the user to unpack. Also, the use of the carton as the outer wrap of the glass roving package disadvantageously leads to an increase in the cost of the glass roving package.

With the above problems in mind, the present invention has been made. It is an object of the present invention to provide a glass roving package having a simple configuration which can prevent shifting and collapse of the glass roving package during transportation of the package, and for which it is easier to package glass rovings and unpack, and the cost of the glass roving package can be reduced.

Solution to Problem

To achieve the above object, a glass roving package according to the present invention includes groups of glass rovings stacked on top of each other on a base board, the glass rovings in each group being arranged, and a wrapping material wrapped around an outer circumferential portion of the groups of glass rovings. A displacement prevention sheet is interposed between a lower group of glass rovings and an upper group of glass rovings.

According to the above configuration, during transportation of the glass roving package, if external force is exerted on the glass roving package due to sudden start or stop of a transport car, transport train, etc. or connection of a trailer, train, etc., the displacement prevention sheet interposed between the upper and lower groups of glass rovings can prevent the upper group of glass rovings from being displaced with respect to the lower group of glass rovings.

Therefore, the simple configuration in which the displacement prevention sheet is interposed between the upper and lower groups of glass rovings can be used to prevent shifting and collapse of the glass roving package during transportation of the package, without using a carton as an outer wrap. As a result, it is easy to package glass rovings and unpack, and the cost of the glass roving package can be reduced.

In the glass roving package of the present invention, the displacement prevention sheet is preferably a foamed resin sheet.

According to the above configuration, the foamed resin sheet is a foamed object, and therefore, the bottom surfaces of the glass rovings in the upper group sink into the foamed resin sheet due to their own weight, while the top surfaces of the glass rovings in the lower group are pressed against the foamed resin sheet due to the weight of the upper group of glass rovings. As a result, the physical integrity of the upper group of glass rovings and the lower group of glass rovings can be improved. Moreover, the foamed resin sheet functions as a cushion for the bottom surfaces of the glass rovings in the upper group and the top surfaces of the glass rovings in the lower group.

Therefore, even if external force is exerted on the glass roving package, so that strong inertial force occurs, the improved physical integrity of the upper and lower groups of glass rovings due to the foamed resin sheet can reliably prevent the upper group of glass rovings from being displaced with respect to the lower group of glass rovings, and therefore, shifting and collapse of the glass roving package can be reliably prevented. Moreover, the cushioning effect of the foamed resin sheet can reduce impact force exerted on the top and bottom surfaces of the glass rovings to protect the glass rovings during stacking of the glass rovings.

In the glass roving package of the present invention, the displacement prevention sheet is preferably configured so that the area of a region where the glass rovings in each group are in contact with the displacement prevention sheet is 50% or more of the area of the bottom surfaces of the glass rovings.

According to the above configuration, the displacement prevention sheet can be made contact with the bottom surfaces of all of the glass rovings in each group with a sufficient contact area, whereby the upper group of glass rovings can be reliably prevented from being displaced with respect to the lower group of glass rovings.

In the glass roving package of the present invention, a communication hole through which a space in which the lower group of glass rovings is provided is in communication with a space in which the upper group of glass rovings is provided, is preferably formed in the displacement prevention sheet.

For example, when each glass roving is wrapped in a shrink film, glass rovings may be stacked on a base board, and thereafter, the stack of glass rovings may be heated to shrink-wrap each glass roving. Also, for example, by performing a thermal treatment on the stacked glass rovings, the tension of glass fiber in each glass roving may be reduced, or the glass strand may be hardened using the viscosity of a binder applied to the glass fiber. When such a thermal treatment is performed, then if the displacement prevention sheet is interposed between the upper group of glass rovings and the lower group of glass rovings, heat may not be uniformly transferred to all glass rovings in some glass roving package configurations. Also, even when a thermal treatment is not performed, then if moisture remains in the glass roving package wrapped in the wrapping material or foreign matter, such as water, dust, etc., enters the package from the outside during transportation of the package, the presence of the displacement prevention sheet may make it difficult to discharge these things from the glass roving package.

According to the above configuration, for example, when a thermal treatment is performed on the stack of glass rovings, the space in which the lower group of glass rovings is provided is in communication with the space in which the upper group of glass rovings is provided through the communication hole, and heat is efficiently transferred to these spaces, whereby a thermal treatment can be uniformly performed on each glass roving. Also, for example, if moisture remains in the glass roving package wrapped in the wrapping material or foreign matter, such as water, dust, etc., enters the package from the outside during transportation of the package, these things can be easily discharged from the glass roving package through the communication hole.

In the glass roving package of the present invention, the communication hole is preferably formed in a surface of the displacement prevention sheet which is not in contact with the upper or lower group of glass rovings.

According to the above configuration, the communication hole can be prevented from being blocked by the glass roving. Therefore, a thermal treatment can be uniformly performed on each glass roving, and moisture remaining in the glass roving package, and foreign matter, such as water, dust, etc., which enters the package from the outside, can be reliably discharged.

In the glass roving package of the present invention, the glass roving preferably has a cylindrical shape having a hollow portion, and the communication hole is preferably formed to allow the hollow portion of the glass roving in the lower group and the hollow portion of the glass roving in the upper group to be in communication with each other.

According to the above configuration, the hollow portion of the glass roving in the lower group is in communication with the hollow portion of the glass roving in the upper group through the communication hole. Therefore, for example, when a thermal treatment is performed on the stack of glass rovings, even if an additional hole for transferring heat to the displacement prevention sheet is not provided, heat is efficiently transferred between the space in which the lower group of glass rovings is provided and the space in which the upper group of glass rovings is provided through the communication hole.

In the glass roving package of the present invention, the communication hole is preferably formed to allow the space in which the lower group of glass rovings is provided and the space in which the upper group of glass rovings is provided to be in communication with each other even in a region excluding the hollow portion of the glass roving.

According to the above configuration, the space in which the lower group of glass rovings is provided and the space in which the upper group of glass rovings is provided are in communication with each other even in a region excluding the hollow portion of the glass roving. Therefore, in a region where glass rovings are adjacent to each other, a gap is formed through which the space in which the upper group of glass rovings is provided is in communication with the space in which the lower group of glass rovings is provided. Heated air can be exchanged between the upper and lower spaces through the gap, whereby a thermal treatment can be uniformly performed on each glass roving. Also, moisture remaining in the glass roving package, and foreign matter, such as water, dust, etc., which enters the package from the outside, can be efficiently discharged.

In the glass roving package of the present invention, the communication hole preferably has a rectangular shape.

According to the above configuration, the communication hole has a rectangular shape. Therefore, in a region where glass rovings are adjacent to each other, a small gap is formed through which the space in which the lower group of glass rovings is provided is in communication with the space in which the upper group of glass rovings is provided. Heated air can be exchanged between the upper and lower spaces through the gap, whereby a thermal treatment can be uniformly performed on each glass roving. Also, the communication hole has a rectangular shape, and therefore, can be easily formed in the surface of the displacement prevention sheet.

In the glass roving package of the present invention, the glass roving preferably has a cylindrical shape having a hollow portion, and a plurality of rectangular displacement prevention sheets are preferably provided between the lower group of glass rovings and the upper group of glass rovings while the hollow portions of the glass rovings in the lower group are in communication with the hollow portions of the glass rovings in the upper group.

According to the above configuration, while the displacement prevention sheets are reliably in contact with the bottom surfaces of all of the glass rovings in each group, a thermal treatment can be uniformly performed on each glass roving, and moisture remaining in the glass roving package, and foreign matter, such as water, dust, etc., which enters the package from the outside, can be effectively discharged without forming a communication hole in the surface of the displacement prevention sheet.

BRIEF DESCRIPTION OF DRAWINGS

FIG. 1 shows a glass roving and a displacement prevention sheet which are used in the present invention. FIG. 1(A)

is a perspective view of the glass roving. FIG. 1(B) is a top view of the displacement prevention sheet.

FIG. 2 shows a glass roving package according to the present invention. FIG. 2(A) is a perspective view of the glass roving package. FIG. 2(B) is an exploded perspective view of the glass roving package.

FIG. 3 shows cross-sectional views of the glass roving package of the present invention. FIG. 3(A) is a horizontal cross-sectional view of the glass roving package, taken along line a-a' of FIG. 2(A). FIG. 3(B) is a vertical cross-sectional view of the glass roving package, taken along line b-b' of FIG. 2(A).

FIG. 4 shows other embodiments of the displacement prevention sheet used in the present invention. FIG. 4(A) is a horizontal cross-sectional view of the glass roving package in which the area of the displacement prevention sheet is changed. FIG. 4(B) is a horizontal cross-sectional view of the glass roving package in which the shape and number of communication holes of the displacement prevention sheet are changed.

FIG. 5 shows other embodiments of the displacement prevention sheet used in the present invention. FIG. 5(A) is a horizontal cross-sectional view of the glass roving package in which the position, shape, and number of communication holes of the displacement prevention sheet are changed. FIG. 5(B) is a top view of the displacement prevention sheet, indicating the position and size of the communication holes.

FIG. 6 shows another embodiment of the displacement prevention sheet used in the present invention. FIG. 6 is a horizontal cross-sectional view of the glass roving package in which a plurality of rectangular displacement prevention sheets are used.

DESCRIPTION OF EMBODIMENTS

Embodiments of a glass roving package according to the present invention will now be described with reference to FIGS. 1 to 6. Note that the present invention is not intended to be limited to configurations described in the embodiments and drawings below.

(Glass Roving Package)

FIG. 1 shows a glass roving 100 and a displacement prevention sheet 10 which are used in the present invention. FIG. 1(A) is a perspective view of the glass roving 100. FIG. 1(B) is a top view of the displacement prevention sheet 10. As shown in FIG. 1(A), the glass roving 100 is, for example, prepared as follows: several hundreds of glass fiber monofilaments of E-glass, AR-glass, etc. having a fiber diameter of several micrometers to several tens of micrometers are bundled together into a strand; a plurality of the strands are grouped together into a glass strand 1 having a predetermined mass density; the glass strand 1 is wound into a cylindrical shape; and the glass strand 1 in the cylindrical shape is shrink-wrapped in an olefin shrink film 2. The glass roving 100 is a generally-cylindrical spool with a circumferential surface 3 and a bottom surface 4 thereof and a portion of an top surface 5 thereof being shrink-wrapped in the olefin shrink film 2. The top surface 5 has an uncovered portion 6 which is not covered with the shrink film 2. In the glass roving 100, an end of the glass strand 1 is drawn out through the uncovered portion 6 and put on the circumferential surface 3 of the shrink film 2 so that the glass strand 1 can be easily unwound from the inner layer thereof. If the olefin shrink film 2 has suitable stiffness, even when the glass strand 1 is unwound from the inner layer of the glass roving 100, leaving only the outermost layer of the glass roving 100, the shrink film 2 which has been used in shrink wrap can stand on its own.

The glass roving 100 typically has an outer diameter of 250 to 300 mm, a height of 260 to 270 mm, and a weight of 25 to 30 kg. However, the glass roving 100 may have various dimensions, depending on the application.

As shown in FIG. 1(B), the displacement prevention sheet 10 is interposed between a pad 21 described below and a lower group (or layer) of glass rovings 100, between a lower group (or layer) of glass rovings 100 and an upper group (or layer) of glass rovings 100, and between an upper group (or layer) of glass rovings 100 and the uppermost group (or layer) of glass rovings 100, in order to prevent the glass rovings 100 from being displaced during transportation of the package.

The displacement prevention sheet 10 may be an elastic resin sheet which can be used as a shock-absorbing material, cushioning material, etc., preferably a foamed resin sheet, and more preferably a foamed polyethylene sheet. The displacement prevention sheet 10 has exactly or substantially the same size as that of the top surface of a base board 20 described below. The base board 20 typically has a size of 1130 mm (length)×1130 mm (width). The thickness of the displacement prevention sheet 10 is suitably set based on the material of the displacement prevention sheet 10, the size of the glass roving 100, and the number of groups (or layers) of glass rovings 100 stacked on top of each other. The displacement prevention sheet 10 has nine circular communication holes 11 for causing a space in which a lower group of glass rovings 100 is provided and a space in which an upper group of glass rovings 100 is provided to be in communication with each other. The nine communication holes 11 are symmetric with respect to a center C of the displacement prevention sheet 10, and are formed in the displacement prevention sheet 10 at predetermined intervals. Note that the communication hole 11 may have other shapes, such as a rectangle, triangle, etc., in addition to a circle, and the number of the communication holes 11 may be not more than 8 or not less than 10. The communication hole 11 is not essential. The displacement prevention sheet 10 without the communication hole 11 may be used. Although described in detail below, if the displacement prevention sheet 10 without the communication hole 11 is used, it is advantageous that time and effort to form the communication hole 11 can be removed.

FIG. 2 shows a glass roving package 200 according to the present invention. FIG. 2(A) is a perspective view of the glass roving package 200. FIG. 2(B) is an exploded perspective view of the glass roving package 200. In the glass roving package 200, groups (or layers) of glass rovings 100 neatly arranged are stacked on top of each other. In the glass roving package 200 of FIGS. 2(A) and 2(B), the pad 21 is put on the base board 20, a displacement prevention sheet 10 is put on the pad 21, and a total of 16 glass rovings 100 are neatly arranged in 4 columns and 4 rows. On the glass rovings 100 thus neatly arranged, a displacement prevention sheet 10 is provided to cover the top surfaces 5 of the glass rovings 100 in the lower group. Four columns and four rows of glass rovings 100 are put and neatly arranged on the displacement prevention sheet 10. A displacement prevention sheet 10 is provided on the upper group of glass rovings 100, covering the top surfaces 5 thereof. Another 4 columns and 4 rows of glass rovings 100 are put on the displacement prevention sheet 10. Thus, the three groups (or layers) of 4 columns and 4 rows of glass rovings 100 (i.e., a total of 48 glass rovings 100) are put on the base board 20. Although, in this embodiment, three groups (or layers) of 4 columns and 4 rows of glass rovings 100 are stacked on top of each other, the number of the glass rovings 100 provided in each group (or layer) and the number of the layers may be suitably changed, depending on the size and number of the glass rovings 100 to be transported.

The pad 21 is provided between the lower group of glass rovings 100 and the base board 20 in order to provide a flat plane on the base board 20. The pad 21 can prevent foreign matter, such as dust, insects, etc., from entering from below the base board 20. Also, when there is warp or unevenness on the base board 20, the pad 21 allows the base board 20 to have a flat top surface, thereby stabilizing the glass roving package 200. As the pad 21, any shock-absorbing material or cushioning material that can flatten the warp or unevenness of the base board 20 can be used. For example, a foamed resin sheet, such as a foamed polyethylene sheet etc., can accommodate the warp or unevenness of the base board 20 by elastic deformation, thereby stabilizing the glass roving package 200. Note that a tray (not shown) may be used instead of the pad 21. In this case, the tray may be preferably one which is made of cardboard and has an orthogonal corrugated pattern as viewed from above. Communication holes 11 similar to those of the displacement prevention sheet 10 may be formed in the pad 21. The displacement prevention sheet 10 may be put on the base board 20 without providing the pad 21 or a tray. The glass roving 100 may be directly put on the base board 20 without providing the displacement prevention sheet 10.

The top surfaces of the glass rovings 100 in the uppermost group may be optionally covered with a cover sheet 22. Note that the displacement prevention sheet 10 may be used instead of the cover sheet 22, i.e., the same package material may be used as different parts of the package. In this case, the displacement prevention sheet 10 without the communication hole 11 may be used.

A stretch film 23 is wrapped around an outer circumferential portion of the stack of glass rovings 100 so that the glass rovings 100 of each group are fastened together with a predetermined tension being exerted on the glass rovings 100. Instead of the stretch film 23 which is wrapped around the stack of glass rovings 100, a polyolefin heat-shrink film may be used for shrink wrap. If the heat-shrink film is used to shrink-wrap the glass rovings 100, the physical integrity of the base board 20 and the stack of glass rovings 100 can be improved, whereby the glass rovings 100 can be reliably fixed.

The base board 20 may be made of any material that is resistant to a thermal treatment described below, such as wood, metal, synthetic resin, etc. The base board 20 preferably has openings which admit the forks of a forklift etc. so that the package can be moved, or loaded into a car etc. Although, in this embodiment, the base board 20 is in the shape of a pallet as an example, any base board with a different structure that has sufficient stiffness to support the glass rovings 100 may be used.

When a foamed polyethylene sheet (e.g., MIRAMAT (registered trademark) manufactured by JSP Corporation) which is a foamed resin sheet is used as the displacement prevention sheet 10, the foamed polyethylene sheet preferably has a thickness of 0.25 to 5 mm, more preferably 0.5 to 3 mm. If the thickness is smaller than 0.25 mm, the sheet is likely to be broken when the glass rovings 100 are stacked. If the thickness is greater than 3 mm, the unit price of the displacement prevention sheet 10 increases, resulting in an increase in the cost of the glass roving package 200. If the displacement prevention sheet 10 having such a material and thickness is employed, the bottom surfaces 4 of the glass rovings 100 in the upper group reliably sink into the displacement prevention sheet 10, while the displacement prevention sheet 10 is reliably pressed against the top surfaces 5 of the glass rovings 100 in the lower group, whereby the physical integrity of the upper group of glass rovings 100 and the lower group of glass rovings 100 can be improved. Therefore, even if external force is exerted on the glass roving package 200 during transportation of the package, so that strong inertial force occurs, the upper group of glass rovings 100 can be reliably prevented from being displaced with respect to the lower group of glass rovings 100. Moreover, the cushioning effect of the foamed polyethylene sheet can protect the bottom and top surfaces 4 and 5 of the glass roving 100, thereby preventing the glass roving 100 from being damaged.

The displacement prevention sheet 10 preferably has a melting point of 100° C. or more. As a result, even when a thermal treatment is performed on the stack of glass rovings 100 as described below, the displacement prevention sheet 10 is not melted.

Note that the thickness of the displacement prevention sheet 10 for each group may be changed, depending on the number of the groups and the size of the glass roving 100. Specifically, for example, a load applied to the displacement prevention sheet 10 is greater for the lower group than for the upper group. Therefore, the thickness of the lower displacement prevention sheet 10 may be greater than that of the upper displacement prevention sheet 10.

(Procedure for Producing Glass Roving Package)

A procedure for producing the glass roving package 200 will be described. Initially, the pad 21 and a displacement prevention sheet 10 are put on the base board 20. After the pad 21 and the displacement prevention sheet 10 are put on the base board 20, glass rovings 100 are put on the displacement prevention sheet 10. In this embodiment, a total of 16 glass rovings 100 are neatly arranged on the displacement prevention sheet 10 in 4 columns and 4 rows before a displacement prevention sheet 10 is provided to cover all of the top surfaces 5 of the 16 glass rovings 100. Next, a total of 16 glass rovings 100 are arranged on the displacement prevention sheet 10 in 4 columns and 4 rows, on top of the lower group of glass rovings 100. In this case, the communication holes 11 formed in the displacement prevention sheet 10 can be used as a guide to easily neatly arrange glass rovings 100 in each group on the displacement prevention sheet 10 and stack the groups on top of each other. By repeatedly performing this process, three groups of glass rovings 100, each group including 4 columns and 4 rows of glass rovings 100 (a total of 48 glass rovings 100), are stacked on top of each other, on the pad 21, to form the stack of glass rovings 100.

Next, a thermal treatment is performed on the stack of glass rovings 100. Specifically, the stack of glass rovings 100 is placed in a high-temperature chamber etc., in which the thermal treatment is performed. As a result, the stress of tension occurring during winding of a strand of the glass roving 100 is reduced, the glass strand 1 is fixed by a binder which has been applied during winding of the strand, and each glass roving 100 is shrink-wrapped. The thermal treatment is performed under the following conditions: at 70 to 100° C. and for 4 hours, preferably at 70 to 90° C. and for 4 hours, and more preferably at 75 to 85° C. and for 4 hours. By the thermal treatment, the reduction of the stress of tension on the glass rovings 100, the fixing of the glass strand 1, and the shrink-wrapping of each glass roving 100 can be simultaneously achieved without melting the displacement prevention sheet 10.

Next, the cover sheet 22 is optionally put on the top surface of the stack of glass rovings 100, and the stack of glass rovings 100 is wrapped in the stretch film 23. In this case, after the cover sheet 22 is put on the top surface of the stack of glass rovings 100, the above thermal treatment may be performed to wrap the stack of glass rovings 100 in the stretch film 23. The stretch film 23 is, for example, wrapped around an outer circumferential portion of the stack of glass rovings 100 including the base board 20, from a lower portion to an upper portion thereof, uniformly covering the outer circumferential portion. In this case, the stretch film 23 is wrapped around the outer circumferential portion of the stack of glass rovings 100 while continuously exerting a predetermined tension thereto so that the glass rovings 100 in each group are made tight contact with each other. The stretch film 23 is wrapped around the outer circumferential portion of the stack of glass rovings 100 under suitable conditions which do not cause shifting or collapse, taking into consideration the number of the glass rovings 100 in each group, the number of the groups in the glass roving package 200, and the physical properties of the glass roving 100. The stretch film 23 may be any one that allows for stretch wrap, and may be made of, for example, polyethylene film. Although, in this embodiment, the stack of glass rovings 100 is directly wrapped in the stretch film 23, in another embodiment, shown in FIG. 4(A), each group of glass rovings 100 in the collection may be bundled using a bundling strap 24, and the stack of glass rovings 100 bundled with the bundling strap 24 may be wrapped in the stretch film 23.

When the glass roving package 200 is unpacked, the stretch film 23 can be easily removed only by cutting the stretch film 23 at a portion where the stretch film 23 is not in contact with the glass rovings 100. As a result, the user can easily unpack without damaging the product, i.e., the glass rovings 100.

(Cross-Sectional Structure of Glass Roving Package)

FIG. 3 shows cross-sectional views of the glass roving package of the present invention. FIG. 3(A) is a horizontal cross-sectional view of the glass roving package, taken along line 3(A)-3(A)of FIG. 2(A). FIG. 3(B) is a vertical cross-sectional view of the glass roving package, taken along line 3(B)-3(B) of FIG. 2(A). As shown in FIG. 3, the glass rovings 100 are neatly arranged in 4 columns and 4 rows, and the glass rovings thus neatly arranged are in contact with each other. The displacement prevention sheet 10 is put on the top surfaces 5 of the neatly arranged glass rovings 100, covering all of the glass rovings 100.

As shown in FIG. 3(A), the 9 communication holes 11 formed in the displacement prevention sheet 10 are each positioned in a region of the sheet surface surrounded by the circumferential surfaces 3 of the corresponding four of the 16 glass rovings 100 (a region of the sheet surface which is not in contact with the glass rovings 100). Therefore, the communication holes 11 are formed in the surface of the displacement prevention sheet 10 which is not in contact with the upper or lower group of glass rovings 100. As a result, a space in which the lower group of glass rovings 100 is provided is in communication with a space in which the upper group of glass rovings 100 is provided through the communication holes 11, and therefore, even if a thermal treatment is performed on the stack of glass rovings 100, heat is efficiently transferred to these spaces, whereby the thermal treatment can be uniformly performed on each glass roving 100.

As shown in FIG. 3(B), the stretch film 23 is wrapped around the glass rovings 100 located at an outer circumference of each group in the stack of glass rovings 100 with a predetermined tension being exerted on the glass rovings 100 so that the stretch film 23 is in tight contact with the glass rovings 100. As described above, the glass rovings 100 neatly arranged in each group are in contact with each other. As a result, by wrapping the stack of glass rovings 100 in the stretch film 23 with a predetermined tension being exerted on the glass rovings 100, the physical integrity of the glass rovings 100 in each group can be improved. Moreover, as described above, the physical integrity of the upper group of glass rovings 100 and the lower group of glass rovings 100 can be reliably improved by the displacement prevention sheet 10. Therefore, the physical integrity of the stack of glass rovings 100 by the stretch film 23, and the physical integrity of the stack of glass rovings 100 by the displacement prevention sheet 10, can reliably and effectively prevent shifting and collapse of the glass roving package 200 during transportation of the package. As a result, shifting and collapse of the glass roving package 200 during transportation of the package can be reliably prevented without using a carton as an outer wrap, resulting in a reduction in the cost of the glass roving package 200 and the amount of waste which occurs after unpacking of the glass roving package 200.

(Other Embodiments)

FIG. 4 shows other embodiments of the displacement prevention sheet 10 used in the present invention. FIG. 4(A) is a horizontal cross-sectional view of the glass roving package 200 in which the area of the displacement prevention sheet 10 is changed. FIG. 4(B) is a horizontal cross-sectional view of the glass roving package 200 in which the shape and number of the communication holes 11 of the displacement prevention sheet 10 are changed. FIG. 5 shows other embodiments of the displacement prevention sheet 10 used in the present invention. FIG. 5(A) is a horizontal cross-sectional view of the glass roving package 200 in which the position, shape, and number of the communication holes 11 of the displacement prevention sheet 10 are changed. FIG. 5(B) is a top view of the displacement prevention sheet 10, indicating the position and size of the communication holes 11. FIG. 6 shows another embodiment of the displacement prevention sheet 10 used in the present invention. FIG. 6 is a horizontal cross-sectional view of the glass roving package 200 in which a plurality of rectangular displacement prevention sheets 10 are used.

(1) In the above embodiment, the displacement prevention sheet 10 is in contact with the entire top surfaces 5 of the glass rovings 100 in the lower group, and is also in contact with the entire bottom surfaces 4 of the glass rovings 100 in the upper group. Alternatively, if the area of a region where each of the glass rovings 100 in each group is in contact with the displacement prevention sheet 10 is 50% or more of the area of the bottom surface 4 of the glass roving 100, preferably 85% or more, the displacement prevention sheet 10 may not be in contact with the entire top surface 5 of each glass roving 100 in the lower group or the entire bottom surface 4 of each glass roving 100 in the upper group. Specifically, for example, in the alternative embodiment of FIG. 4(A), the displacement prevention sheet 10 has a smaller area than that of the above embodiment. In this displacement prevention sheet 10, the area of a region where the bottom surface 4 of each of 12 glass rovings 100 located at the outer circumferential portion of the glass rovings 100 neatly arranged in 4 columns and 4 rows are in contact with the displacement prevention sheet 10 is 85% or more (about 90%) of the area of the bottom surface 4 of the glass roving 100. With this configuration, the amount of the displacement prevention sheet 10 which is used can be reduced while shifting and collapse of the glass roving package 200 are prevented, and therefore, the cost of the package of the glass rovings 100 can be further reduced.

(2) In the above embodiment, the 9 communication holes 11 through which the space in which the lower group of glass rovings 100 is provided is in communication with the space in which the upper group of glass rovings 100 is provided, are formed in a region of the surface of the displacement prevention sheet 10 which is not in contact with the 16 glass rovings 100 in each group. Alternatively, the communication hole 11 may be formed, extending between a region of the surface of the displacement prevention sheet 10 which is not in contact with the glass roving 100 and a region of the surface of the displacement prevention sheet 10 which is in contact with the glass roving 100. Specifically, for example, in the alternative embodiment of FIG. 4(B), five L-shaped communication holes 11 are formed, for communication, in three regions of the surface of the displacement prevention sheet 10 which are not in contact with the glass roving 100. As a result, a smaller number of communication holes 11 can be used so that the space in which the lower group of glass rovings 100 is provided is in communication with the space in which the upper group of glass rovings 100 is provided, whereby heat can be efficiently transferred to the glass rovings 100 in each group.

(3) The glass roving 100 is produced by winding the glass strand 1 into a cylindrical shape, and therefore, a hollow portion 7 is formed in a center portion of the glass roving 100. The glass rovings 100 are stacked on top of each other so that the hollow portions 7 of the glass rovings 100 in the lower group are substantially aligned with the respective corresponding hollow portions 7 of the glass rovings 100 in the upper group. The communication holes 11 may be formed in the surface of the displacement prevention sheet 10 so that the hollow portions 7 of the glass rovings 100 in the lower group are in communication with the hollow portions 7 of the glass rovings 100 in the upper group. Specifically, for example, in the alternative embodiment of FIG. 5(A), the communication hole 11 is formed in a rectangular shape, extending along the glass rovings 100 arranged in a column (the vertical direction in FIG. 5), in the surface of the displacement prevention sheet 10 so that the hollow portions 7 of the glass rovings 100 in the lower group are in communication with the hollow portions 7 of the glass rovings 100 in the upper group. In this displacement prevention sheet 10, the area of a region where the bottom surface 4 of each of 8 glass rovings 100 in the second and third rows of the glass rovings 100 neatly arranged in 4 columns and 4 rows is in contact with the displacement prevention sheet 10 is 50% or more (about 50%) of the area of the bottom surface 4 of the glass roving 100. For example, if the stacked glass roving 100 has an outer diameter of 275 mm, and as shown in FIG. 5(B), the length a of a side of the displacement prevention sheet 10 is 1100 mm, the width b of the communication hole 11 is 100 mm, the distance c between each communication hole 11 is 165 mm, and the distance d between the communication hole 11 and a side of the displacement prevention sheet 10 is 102.5 mm, the area of the region where the glass rovings 100 in the second and third rows are in contact with the displacement prevention sheet 10 can be set to about 50%. With this configuration, the hollow portions 7 of the glass rovings 100 in the lower group are in communication with the hollow portions 7 of the glass rovings 100 in the upper group through the communication holes 11. Therefore, heat is efficiently transferred through the communication holes 11 between the space in which the lower group of glass roving 100 is provided and the space in which the upper group of glass rovings 100 is provided. Also, the communication hole 11 is formed in a rectangular shape in the surface of the displacement prevention sheet 10 so that the communication hole 11 extends over adjacent glass rovings 100, while the communication hole 11 allows the hollow portions 7 of the glass roving 100 in the lower group and the hollow portions 7 of the glass rovings 100 in the upper group to be in communication with each other. Therefore, in a region where the glass rovings 100 are adjacent to each other, a small gap 11*a* is formed which allows the space in which the lower group of glass rovings 100 is provided and the space in which the upper group of glass rovings 100 is provided to be in communication with each other. Heated air can be transferred between the upper and lower spaces through the gap 11*a*, and therefore, a thermal treatment can be uniformly performed on each glass roving 100. Also, moisture remaining in the glass roving package 200, and foreign matter, such as water, dust, etc., which enters the package from the outside, can be efficiently discharged. Moreover, the amount of waste which occurs after unpacking of the glass roving package 200 can be reduced.

(4) In the above embodiment, the communication hole 11 is formed in the surface of the displacement prevention sheet 10. Alternatively, a rectangular displacement prevention sheet 10 without the communication hole 11 may be produced. In this case, while the hollow portions 7 of the glass rovings 100 in the groups are in communication with each other, a plurality of rectangular displacement prevention sheets 10 may be provided between the lower group of glass rovings 100 and the upper group of glass rovings 100 with a gap being interposed between each rectangular displacement prevention sheet 10. Specifically, for example, in the alternative embodiment of FIG. 6, a displacement prevention sheet (not shown) which has not been used is cut into rectangular strips. Five rectangular displacement prevention sheets 10 are made contact with the glass rovings 100 neatly arranged in 4 columns and 4 rows in each group while the displacement prevention sheets 10 do not cover or overlap the hollow portions 7, so that communication in the hollow portions 7 of the glass rovings 100 in each column (the vertical direction of FIG. 6) can be maintained. The five displacement prevention sheets 10 are arranged so that the area of a region where the bottom surface 4 of each glass roving 100 is in contact with the displacement prevention sheet 10 is 50% or more (about 50%) of the area of the bottom surface 4 of the glass roving 100. For example, if the stacked glass roving 100 has an outer diameter of 275 mm, as shown in FIG. 6 the length a in the longitudinal direction of the displacement prevention sheet 10 is set to 1100 mm, the width b of the displacement prevention sheets 10 which are each in contact with only one column of glass rovings 100 at the corresponding one of both ends in the horizontal direction of FIG. 6 is set to 102.5 mm, and the width c of three displacement prevention sheets 10 which are each in contact with two adjacent columns of glass rovings 100 is set to 165 mm. In this case, the displacement prevention sheet 10 is in contact with the bottom surfaces 4 of the glass rovings 100 while communication in the hollow portions 7 of the glass rovings 100 is maintained. As a result, the area of a region where the glass roving 100 is in contact with the displacement prevention sheet 10 can be set to about 50%. Therefore, heat can be efficiently transferred to the glass rovings 100 in each group without forming the communication hole 11 in the surface of the displacement prevention sheet 10, while shifting and collapse of the glass roving package 200 are prevented. Moreover, the amount of waste which occurs after unpacking of the glass roving package 200 can be reduced.

INDUSTRIAL APPLICABILITY

The glass roving package of the present invention is applicable to a glass roving package including glass rovings of various sizes and types.

REFERENCE SIGNS LIST

10 DISPLACEMENT PREVENTION SHEET
11 COMMUNICATION HOLE
20 BASE BOARD
23 STRETCH FILM (WRAPPING MATERIAL)
100 GLASS ROVING
200 GLASS ROVING PACKAGE

The invention claimed is:

1. A glass roving package including groups of glass rovings stacked on top of each other on a base board, the glass rovings in each group being arranged, and a wrapping material wrapped around an outer circumferential portion of the groups of glass rovings, wherein a displacement prevention sheet is interposed between a lower group of glass rovings and an upper group of glass rovings and the displacement prevention sheet comprises a foamed resin sheet which is in contact with bottom surfaces of the glass rovings in the upper group of glass rovings, wherein each group of glass rovings is bundled using a bundling strap and the wrapping material is wrapped around the bundling strap together with the outer circumferential portion of the groups of glass rovings.

2. A glass roving package including groups of glass rovings stacked on top of each other on a base board, the glass rovings in each group being arranged, and a wrapping material wrapped around an outer circumferential portion of the groups of glass rovings, wherein a displacement prevention sheet is interposed between a lower group of glass rovings and an upper group of glass rovings and the displacement prevention sheet comprises a foamed resin sheet which is in contact with bottom surfaces of the glass rovings in the upper group of glass rovings, wherein each glass roving in the groups of glass rovings has a cylindrical shape having a hollow portion, and a plurality of rectangular displacement prevention sheets are provided between the lower group of glass rovings and the upper group of glass rovings while the hollow portions of the glass rovings in the lower group are in communication with the hollow portions of the glass rovings in the upper group, and wherein each group of glass rovings is bundled using a bundling strap and the wrapping material is wrapped around the bundling strap together with the outer circumferential portion of the groups of glass rovings.

3. The glass roving package of claim 2, wherein the displacement prevention sheet is configured so that the area of a region where the glass rovings in each group are in contact with the displacement prevention sheet is 50% or more of the area of the bottom surfaces of the glass rovings.

* * * * *